US009039520B2

(12) United States Patent
Harris et al.

(10) Patent No.: US 9,039,520 B2
(45) Date of Patent: May 26, 2015

(54) PAYOUT SYSTEMS AND METHODS

(71) Applicants: David Harris, Cumming, GA (US); Gregory Gronau, Las Vegas, NV (US); Jack Saltiel, Lawrenceville, GA (US)

(72) Inventors: David Harris, Cumming, GA (US); Gregory Gronau, Las Vegas, NV (US); Jack Saltiel, Lawrenceville, GA (US)

(73) Assignee: Cadillac Jack, Inc., Duluta, GA (US)

( * ) Notice: Subject to any disclaimer, the term of this patent is extended or adjusted under 35 U.S.C. 154(b) by 0 days.

(21) Appl. No.: 14/030,751

(22) Filed: Sep. 18, 2013

(65) Prior Publication Data

US 2014/0024440 A1 Jan. 23, 2014

Related U.S. Application Data

(63) Continuation of application No. 11/693,915, filed on Mar. 30, 2007, now Pat. No. 8,574,063.

(51) Int. Cl.
*A63F 9/24* (2006.01)
*G07F 17/32* (2006.01)

(52) U.S. Cl.
CPC ..... *G07F 17/3244* (2013.01); *G07F 17/32* (2013.01); *G07F 17/3262* (2013.01)

(58) Field of Classification Search
CPC . G07F 17/3244; G07F 17/323; G07F 17/326; G07F 17/3211; G07F 17/3227
USPC ..... 463/16–20, 23, 25
See application file for complete search history.

(56) References Cited

U.S. PATENT DOCUMENTS

| | | | | |
|---|---|---|---|---|
| 6,068,552 | A * | 5/2000 | Walker et al. | 463/21 |
| 2003/0195031 | A1 * | 10/2003 | O'Donovan et al. | 463/16 |
| 2004/0048657 | A1 * | 3/2004 | Gauselmann | 463/25 |
| 2004/0121833 | A1 * | 6/2004 | Mezen et al. | 463/16 |
| 2004/0185932 | A1 * | 9/2004 | Lombardo | 463/21 |
| 2005/0043092 | A1 * | 2/2005 | Gauselmann | 463/36 |
| 2005/0071023 | A1 * | 3/2005 | Gilliland et al. | 700/91 |
| 2005/0248568 | A1 * | 11/2005 | Payne | 345/420 |
| 2005/0282615 | A1 * | 12/2005 | Englman et al. | 463/20 |
| 2006/0084496 | A1 * | 4/2006 | Jaffe et al. | 463/20 |
| 2007/0060252 | A1 * | 3/2007 | Taylor | 463/16 |
| 2007/0238508 | A1 * | 10/2007 | Chilton et al. | 463/20 |
| 2008/0113811 | A1 * | 5/2008 | Linard et al. | 463/42 |

* cited by examiner

*Primary Examiner* — Steve Rowland
(74) *Attorney, Agent, or Firm* — CF3; Stephen Eisenmann

(57) ABSTRACT

Various embodiments of payout systems and methods are disclosed. One embodiment, among others, comprises providing a defined payout amount and a party adjustable payout volatility for a video gaming device, and responsive to party input, modifying the payout volatility while maintaining the defined payout amount.

17 Claims, 7 Drawing Sheets

PAYOUT SYSTEMS AND METHODS

CROSS-REFERENCE TO RELATED PATENT APPLICATION

This application is a continuation of prior application Ser. No. 11/693,915 entitled "PAYOUT SYSTEMS AND METHODS", filed on Mar. 30, 2007, which is incorporated herein by reference in its entirety.

FIELD

DESCRIPTION

TECHNICAL FIELD

The present disclosure relates to gaming systems and, more particularly, to electronic gaming systems.

BACKGROUND

Gaming machines such as mechanically driven slot machines have been a staple of the gaming and entertainment industries for years. With the advent of computers, electronic forms of gaming machines such as video slots, video bingo, video poker, video keno and video blackjack have emerged and become increasingly popular. Such electronic devices continue to grow in popularity with the development of enhanced computer-generated graphics and sounds, making them more attractive to a wider audience of participants.

With the recent growth in the electronic gaming machine market, competition between manufacturers to place their equipment in available venues has become fierce. When selecting which machines to put into their facilities, the operators of gaming establishments give substantial consideration to their patrons' perception of a game as being entertaining and exciting.

One aspect to providing excitement in play involves how often a player receives a payout and at what amount. Player preference in this respect is as varied as the machines. That is, there exists variations in the manner machines provide such payouts and consequently, some players desire some machines more than others based on these differences. For instance, some gaming machines provide a payout with low frequency, but of significant dollar value. On the other hand, some machines provide low dollar amount payouts but with relatively high frequency. Other machines provide variations in between. Ultimately, one need with these and other systems is that of encouraging continued play.

SUMMARY

Various embodiments of payout systems and methods are disclosed. One embodiment, among others, comprises providing a defined payout amount and a player adjustable payout volatility for a video gaming device, and responsive to player input, modifying the payout volatility while maintaining the defined payout amount.

Other systems, methods, features, and advantages of the present disclosure will be or become apparent to one with skill in the art upon examination of the following drawings and detailed description. It is intended that all such additional systems, methods, features, and advantages be included within this description, and be within the scope of the present disclosure.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the disclosed systems and methods. Moreover, in the drawings, like reference numerals designate corresponding parts throughout the several views.

DETAILED DESCRIPTION

Disclosed herein are various embodiments of payout systems and methods (collectively, "payout systems"). Such payout systems enable a player to adjust payout volatility of a gaming machine that he or she is playing. Volatility generally refers to the variability of frequency and/or magnitude of a reward (i.e., payout) provided to a player of a gaming machine. In conventional systems, the player is provided no ability to adjust the payout volatility of a game, and hence, the frequency and volatility of a gaming machine remains fixed according to the parameters set by the game software on site via read-only-memory (ROM) devices or downloaded from a game server. Providing a player with the ability to adjust the payout volatility can increase excitement of play and improve satisfaction by tailoring the outcome to suit individual tastes.

The present disclosure now will be described more fully hereinafter with reference to the accompanying drawings, in which some, but not all embodiments are shown. Indeed, the disclosed systems and methods may be embodied in many different forms and should not be construed as limited to the embodiments set forth herein. Rather, these embodiments are provided so that this disclosure will satisfy applicable legal requirements.

Figure 1:
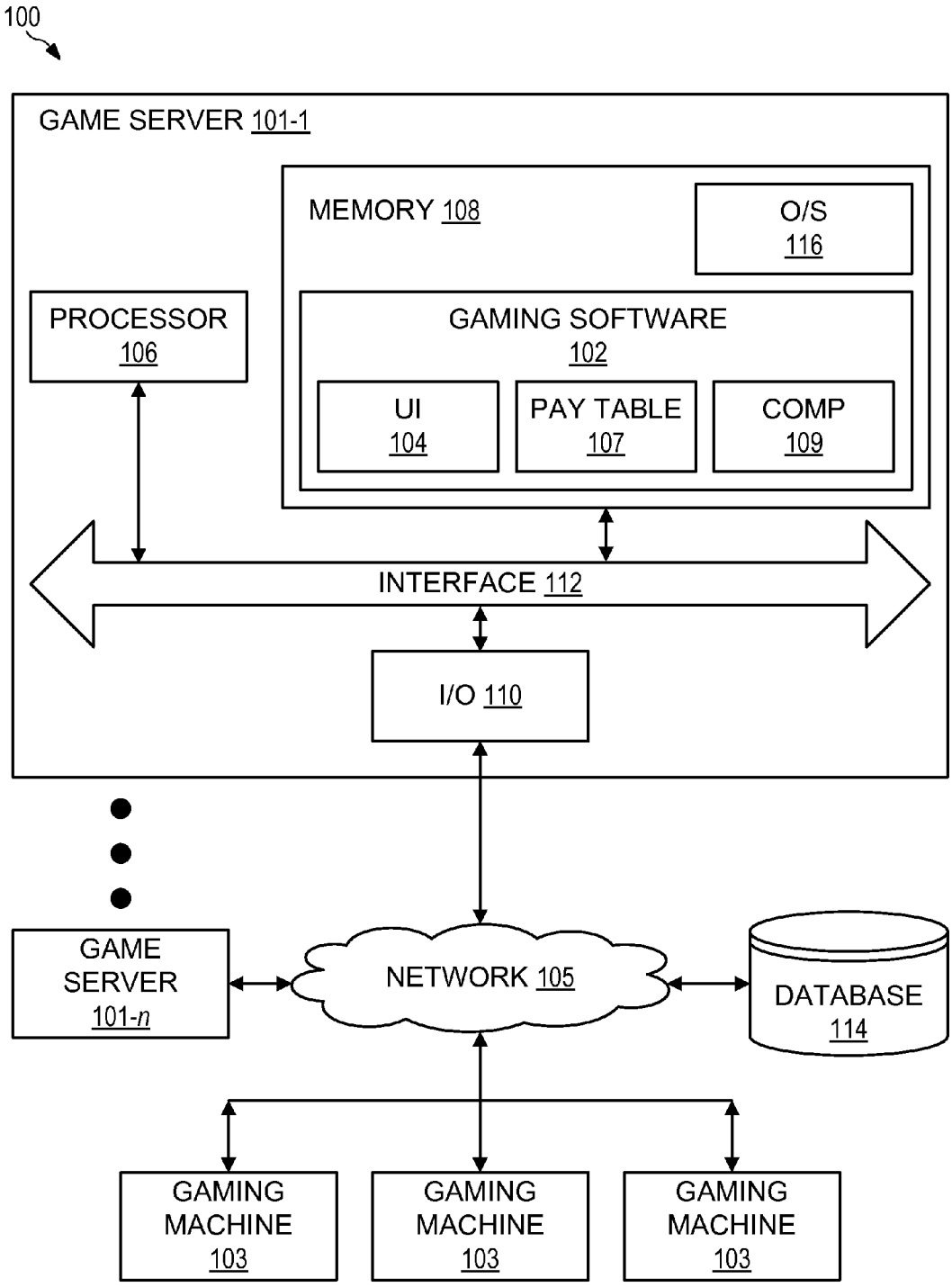
FIG. 1 is a block diagram of an embodiment of a gaming system.

FIG. 1 is a block diagram of an embodiment of a gaming system 100. The gaming system 100 includes one or more game servers 101-1 through **101-*n* networked to a plurality of individual gaming machines 103 via a network 105 (e.g., a local area network (LAN) such as an Ethernet connection, a wide area network (WAN), or other media). Each gaming machine 103 may be located locally or remotely with respect to one another. In one embodiment, game servers 101-1 through 101-*n* can implement gaming software 102. The gaming software 102 can be implemented in software, as an executable program, and can be executed by a special or general purpose digital computer, such as a personal computer (PC; IBM-compatible, Apple-compatible, or otherwise), workstation, minicomputer, or mainframe computer. The gaming software 102 includes a user-interface (UI) module 104** that provides an interactive equalizer user interface as described below. Web-page or screen display generation and formatting mechanisms involved in generating the various displays are known in the art and, therefore are not discussed here.

The gaming software 102 also includes one or more data structures, such as one or more pay table(s) 107, to provide volatility in the payout, and a computation module 109 that performs calculations necessary to adjust or change the pay table 107. In one embodiment, the volatility is adjusted by a player through an equalizer user interface presented through the UI module 104. The gaming software 102 is also programmed to maintain a fixed return (e.g., fixed percentage) for each respective gaming machine 103, as is known. In other words, regardless of the volatility of the game, the percentage of money wagered that is paid out as winnings remains the same. Hence, the gaming software 102 enables player adjustment of payout volatility via presentation of the equalizer user interface, while maintaining the programmed return.

Additional software modules (integrated with the gaming software 102 or separate) are also included in memory 108, though not shown for brevity, including random number generation software for generating winning combinations (e.g., cards, bingo balls, reels, etc.), among other functions, as should be understood by one having ordinary skill in the art. Although shown integral to the gaming software 102, one having ordinary skill in the art should understand in the context of this disclosure that the UI module 104, the computation module 109, and/or pay tables 107 can be separate modules distributed among various components or devices, and that each module may be further configured using a plurality of submodules. For instance, in one embodiment, the computation module 109 may reside in game server **101-*n*, and the pay tables 107 and/or the UI module 104 may reside in game server 101-1 and/or the gaming machines 103. Such an embodiment may be implemented to provide enough computation capability to perform the calculations necessary to adjust or change the pay tables 107 in gaming machines 103 or game server 101-1 in as quick a manner as possible so as not to keep the player waiting while the changes are computed and made ready for game play. In some embodiments, the gaming software 102 (and accompanying modules) may be located in each gaming machine 103, in addition to or in lieu of being located in game servers 101-1 through 101-*n***.

Generally, in terms of hardware architecture, as shown in FIG. 1, game servers 101-1 through **101-*n* include a processor 106, memory 108, and one or more input and/or output (I/O) devices or peripherals 110 that are communicatively coupled via a local interface 112. The local interface 112 can be, for example, one or more buses or other wired or wireless connections. The local interface 112 may have additional elements (not shown) to enable communications, such as controllers, buffers (caches), drivers, repeaters, and receivers. Further, the local interface 112 may include address, control, and/or data connections to enable appropriate communications among the aforementioned components. Game servers 101-1 through 101-*n* can also communicate with the database 114 via the network 105. The local database 114 can be external to or integral to game servers 101-1 through 101-*n***.

The processor 106 is a hardware device capable of executing software, particularly that stored in memory 108. The processor 106 can be any custom made or commercially available processor, a central processing unit (CPU), an auxiliary processor among several processors associated with the game server 101-1, a semiconductor based microprocessor (in the form of a microchip or chip set), a microprocessor, or generally any device for executing software instructions.

Memory 108 can include any one or combination of volatile memory elements (i.e., random access memory) such as DRAM, SRAM or SDRAM and non-volatile memory elements such as ROM, hard drive, tape or CDROM. Moreover, the memory 108 may incorporate electronic, magnetic, optical, and/or other types of storage media. Note that memory 108 can have a distributed architecture where various components are situated remote from one another but can be accessed by the processor 106.

The software in memory 108 may include one or more separate programs, each of which comprises an ordered listing of executable instructions for implementing logical functions. In one embodiment of a game server 101-1 of FIG. 1, the software in the memory 108 includes the gaming software 102 and a suitable operating system (O/S) 116. The operating system 116 controls the execution of other computer programs, such as the gaming software 102, and provides scheduling, input-output control, file and data management, memory management, and communication control and related services.

The gaming software 102 can be a source program, executable program (object code), script, and/or any other entity comprising a set of instructions to be performed. When a source program, the program may be translated via a compiler, assembler, interpreter, or the like, which may or may not be included within memory 108, so as to operate properly in connection with the operating system 116. Furthermore, the gaming software 102 can be written as (a) an object oriented programming language, which has classes of data and methods, or (b) a procedure programming language, which has routines, subroutines, and/or functions, including but not limited to, C, C++, Pascal, Basic, Fortran, Cobol, Perl, Java, ASP, and Ada.

The gaming software 102 can be stored on any computer readable medium for use by or in connection with any computer related system or method. In the context of this document, a computer readable medium is an electronic, magnetic, optical, or other physical device or means that can contain or store a computer program for use by or in connection with a computer related system or method. The gaming software 102 can be embodied in any computer-readable medium for use by or in connection with an instruction execution system, apparatus, or device, such as a computer-based system, processor-containing system, or other system that can fetch the instructions from the instruction execution system, apparatus, or device and execute the instructions.

The I/O devices 110 may include input devices such as a keyboard, mouse, scanner, microphone, etc., as well as interfaces to various devices (e.g., an interface to one or more progressive displays not shown in FIG. 1). Furthermore, the I/O devices 110 may also include output devices, such as a printer, display, etc. Finally, the I/O devices 110 may further include devices that communicate both inputs and outputs, for instance a modulator/demodulator (modem for accessing another device, system, or network), a radio frequency (RF) or other transceiver, a telephonic interface, a bridge, a router, etc. In one embodiment of the invention, a progressive display (e.g., to display progressive awards) may be connected to the I/O interface 110.

When game servers 101-1 through **101-*n* are in operation, the processor 106 is configured to execute software stored within memory 108, to communicate data to and from memory 108, and to generally control operations of game server 101-1 through 101-*n* pursuant to the software. The gaming software 102 and the operating system 116, in whole or in part, but typically the latter, are read by the processor 106, perhaps buffered within the processor 106**, and then executed.

In addition, the scope of the present disclosure includes embodying the functionality of certain embodiments in logic embodied in hardware or software-configured mediums.

Figure 2:
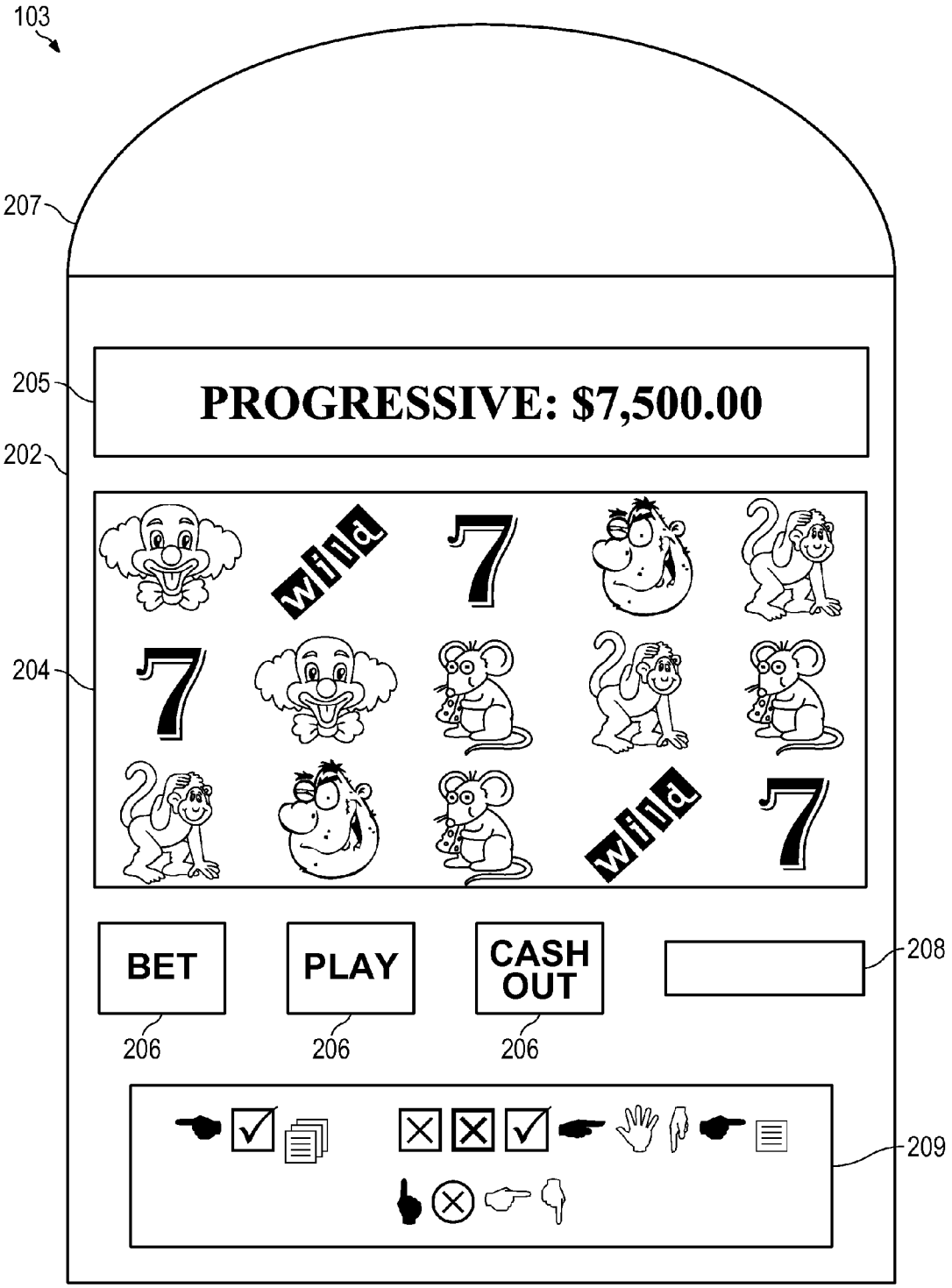
FIG. 2 is a schematic diagram of an embodiment of a video gaming machine of the gaming system shown in FIG. 1.

FIG. 2 depicts an embodiment of a video gaming machine 103. It is noted that the term "gaming machine" may refer to any device, activity or mode of play for gaming (i.e., gambling or redemption), amusement, competition, or other purposes. Additionally, "gaming machine" may refer to a "stand alone" player station or console in which case the outcome of game play is determined locally, or part of a server-based network of gaming machines in which case the outcome of game play is centrally determined. The gaming machine 103 includes a cabinet 202 housing a primary display 204 for displaying game events. The primary display 204 may be a mechanical display such as used in traditional slot machines, or a video display such as a flat panel LCD as used in electronic games such as video bingo, video slots, video poker, video keno or video blackjack. In one embodiment, the gaming machine 103 includes a progressive display 205 for displaying the value of a progressive jackpot. The gaming machine 103 may also include a top glass 207 and a belly glass 209 for displaying various information such as game rules or graphics designed to attract players to participate.

Proximate to the primary display 204 are a series of electromechanical buttons 206 positioned on the cabinet for use as a user interface for controlling game play such as selecting a bet amount, commencing play and cashing out. The specific arrangement and function of each of the electromechanical buttons 206 is dependent upon the type of game being played on the gaming machine 103. For example, for a Blackjack game, the electromechanical buttons 206 may include options for placing a bet, cashing out, hitting or standing, doubling down, purchasing insurance and/or splitting. Alternatively, in a poker game, the electromechanical buttons 206 may include options for placing a bet, cashing out and/or designating which cards to keep and which to discard. In one embodiment, the primary display 204 is a "touch screen" upon which icons corresponding to some or all of the electromechanical buttons 206 appear. The user can activate the functions associated with the icons by simply touching the appropriate area of the primary display 204 rather than depressing the electromechanical buttons 206.

The gaming machine 103 also includes a wager input interface 208, such as a bill acceptor, into which a player inserts paper currency and receives credit on the gaming machine 103 for the amount deposited. In alternate embodiments, the wager input interface 208 can be a ticket reader, a magnetic card reader, or similar mechanisms, into which the player places a ticket or magnetic card encoded with a monetary value purchased from a cashier's station or vending machine.

Figure 3:
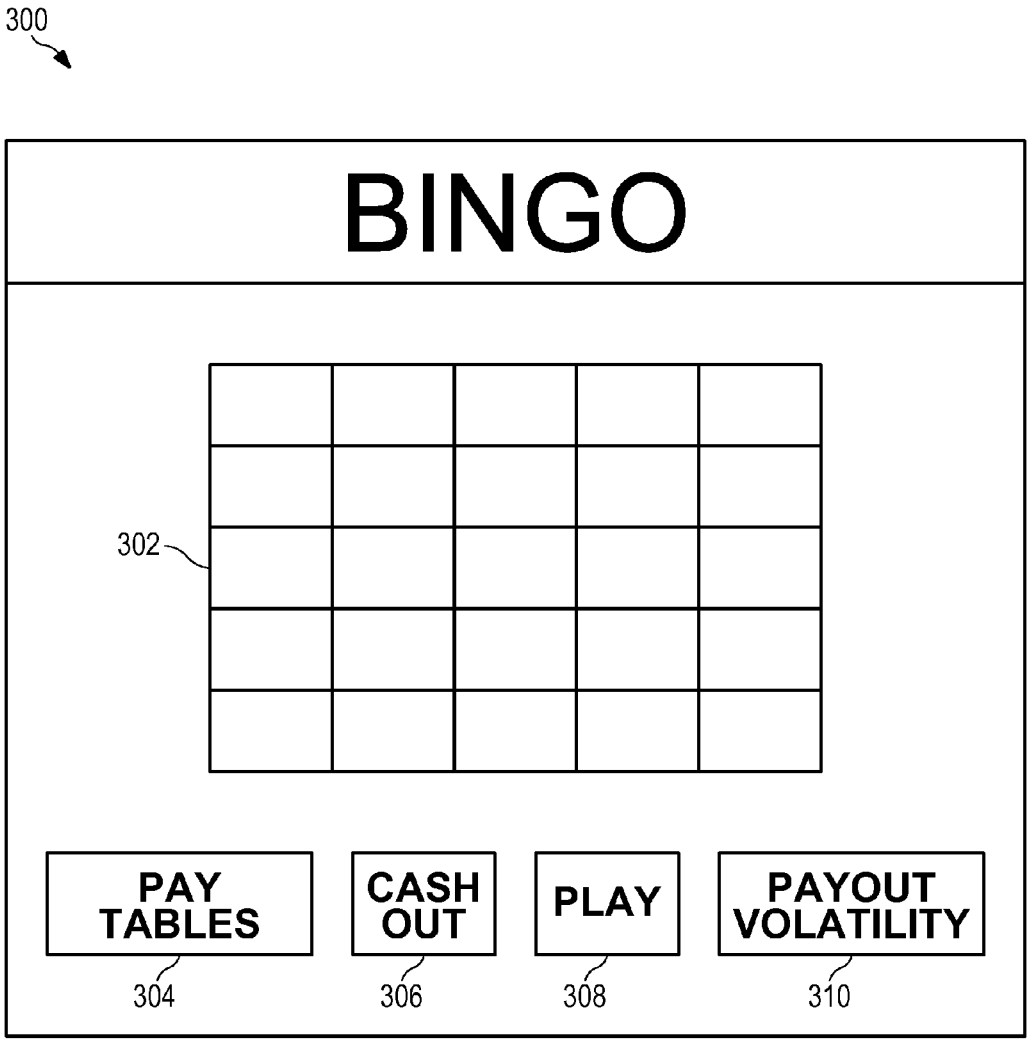
FIG. 3 is a screen diagram of an embodiment of a Bingo game user interface presented on a primary display of the video gaming machine shown in FIG. 2.

FIG. 3 is a screen diagram of an embodiment of a user interface 300 presented on the primary display 204, responsive to a player selecting one of the game icons (e.g., Bingo) from the primary display shown in FIG. 2. By way of example, but not limitation, in a Bingo game, the user interface 300 comprises a display of one or more Bingo "cards" 302, and includes options that are selectable (e.g., directly via touch screen or using electromechanical buttons or other input devices) by the player. For instance, such options may include a pay table button icon 304, a cash out button icon 306, a play button icon 308, and a payout volatility button icon 310. One having ordinary skill in the art should understand that variations in the type of options are included within the scope of the disclosure, including these and/or other button icons for presentation to a player.

Responsive to selecting the pay table button icon 304, a player is presented with a screen (not shown) that presents a plurality of different paylines, which define winning combinations of Bingo patterns. Such a screen or user interface provides button icons or other known input mechanisms to enable the player to select one or more paylines, as well as wager amounts for each payline selected. One having ordinary skill in the art should understand that for other games, such as virtual "reel" games, the paylines presented may include winning combinations of reel symbols or other representations of winning combinations depending on the game selected by the player. The cash out button icon 306 allows a player to terminate a game and receive credit for any value the player has remaining on the game. The play button icon 308 enables the user to commence play of the game on the gaming machine 103. The payout volatility button icon 310 enables a user to select the payout volatility for the selected game. In some embodiments, the payout volatility button icon 310 may be presented in association with, or integral to, the user interface presented in the primary display 204 before a particular game is selected.

Figure 4A:
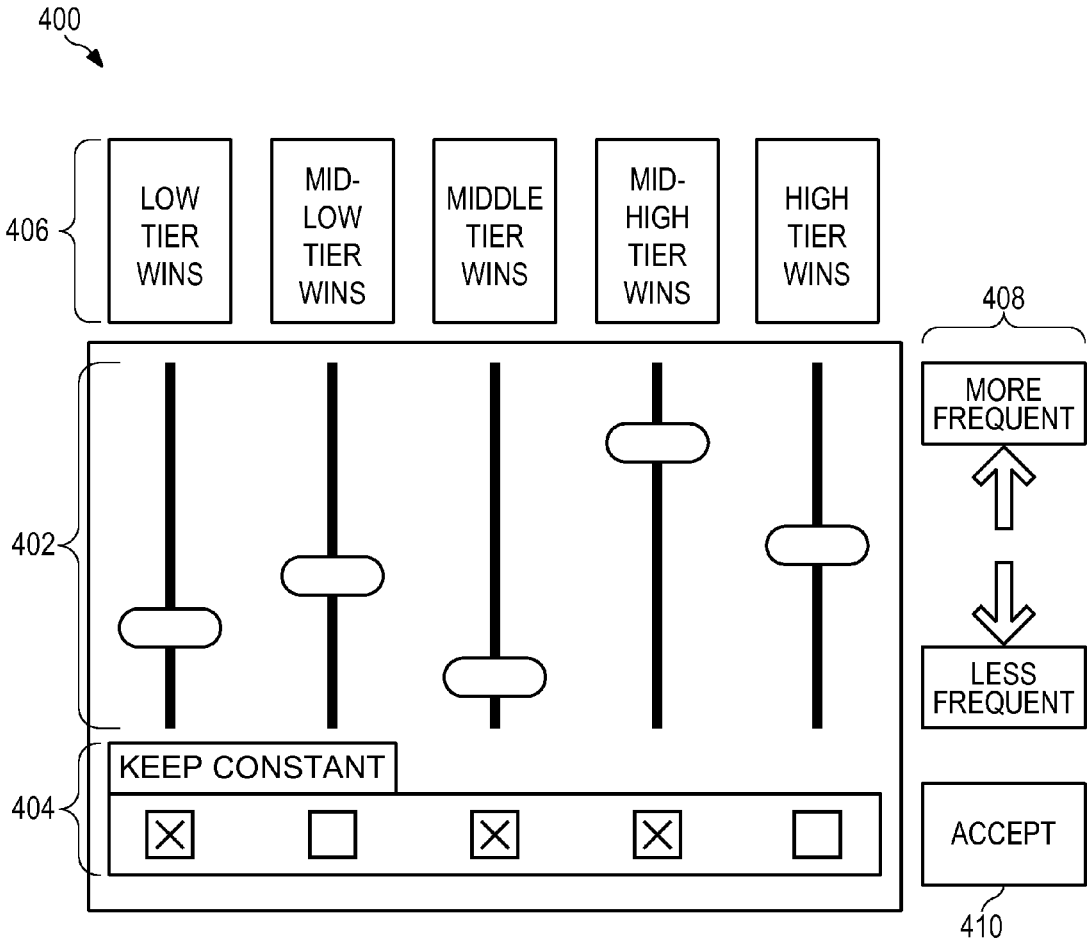
FIG. 4A is a screen diagram of an embodiment of an equalizer user interface presented on a primary display of the video gaming machine shown in FIG. 2.

Responsive to a player selecting the payout volatility button icon 310, an equalizer user interface 400 is presented, as shown in FIG. 4A. In some embodiments, the equalizer user interface 400 may be presented through other mechanisms, such as an icon presented on the primary display 204 before game selection or through activation of an electromechanical button located on the gaming machine 103. The equalizer user interface 400, in one embodiment, is configured in somewhat similar manner to an audio equalizer as found in a home entertainment system, although not limited to the configuration shown in FIG. 4A. Hence, the equalizer user interface 400 includes adjustment levers 402, constant selection boxes 404, "explanation of electromechanical buttons" 406 and 408, the latter two (406 and 408) of which are presented to assist the player in making adjustments, and an accept button icon 410 to accept all adjustments and return to the prior user interface 300 (FIG. 3). Each of the adjustment levers 402 may be maneuvered (e.g., directly via touch screen technology) independently to modify the volatility of the payout based on player preference. In some embodiments, the levers 402 may be replaced with other control mechanisms (e.g., icons) in lieu of or in addition to the levers, such as dials, selectors, etc.

At one extreme, increasing the frequency of low tier wins results in an increase in the frequency of lower denomination payouts (hence effectively increasing the average playing time of the player). On the other hand, increasing the high tier wins results in fewer payouts, but generally each at a greater value. Adjustments falling in between the low and high tier wins results in payouts falling in between these two payout extremes. The number of tier categories can be greater (e.g., more types than shown in FIG. 4A) or fewer (e.g., less types than shown in FIG. 4A).

Additionally, the player is provided the option to control certain types of tier wins as constant via selection of one or more of the constant selection boxes 404. For instance, as shown in FIG. 4A, low tier, middle tier, and mid to high tier wins are checked by the player to maintain the frequency of these types of wins constant, and hence the gaming software 102 implements a routine to maintain the fixed return while adjusting the volatility of payout by adjusting according to player selection the mid-low tier and high tier wins. In some embodiments, if the player attempts to select a combination of payout volatility characteristics that are mathematically impossible or impermissible (i.e., necessarily resulting in a payout percentage greater or less than the payout percentage fixed by the gaming software), the gaming software 102 provides appropriate feedback to the player and the player must alter his or her selections.

In some embodiments, a user interface can be configured differently than that shown in FIG. 4A, such as through the use of scroll down menu selections, horizontal slide scales, one or more dials, among other well-known adjustment mechanisms. In some embodiments, the adjustments may be made without an accompanying display 204, such as knobs or other mechanical or electromechanical adjustment mechanisms residing on the enclosure of the gaming machine 103.

Figure 4B:
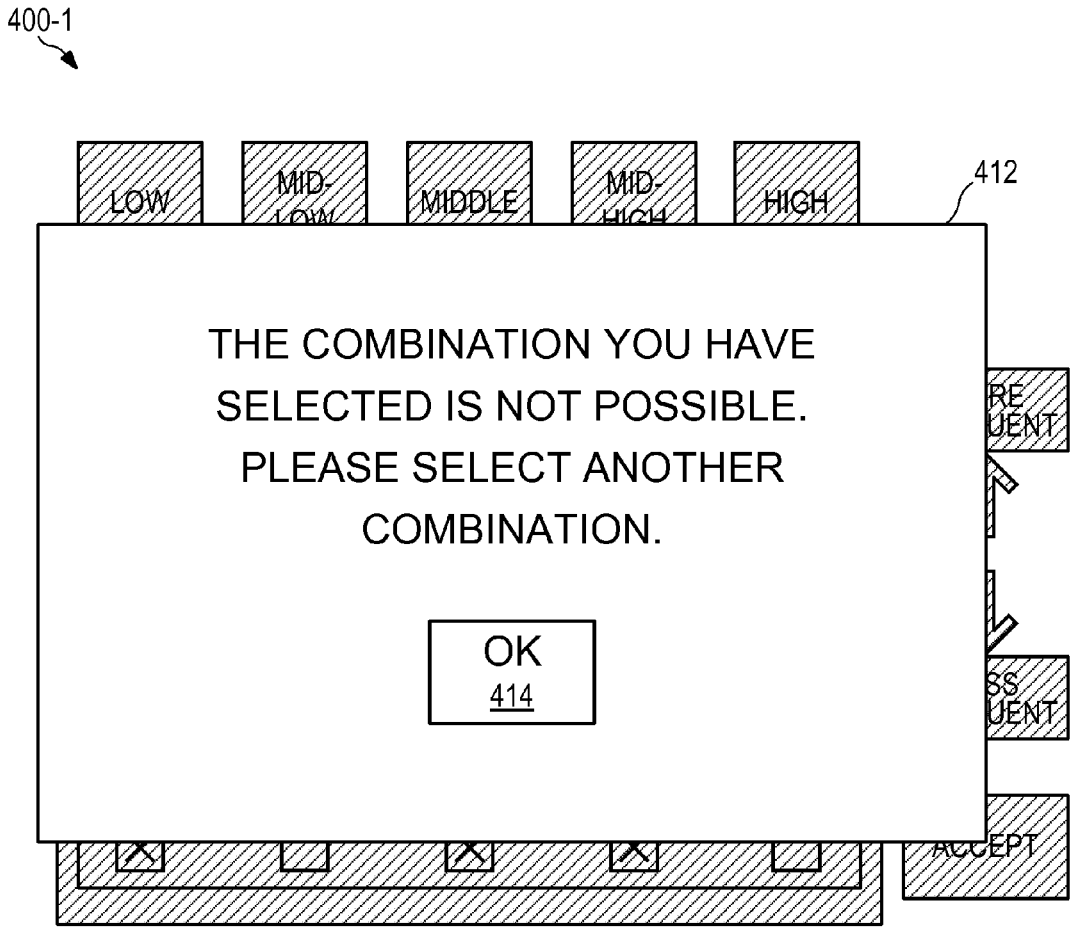
FIG. 4B is a screen diagram of an embodiment of a message overlaid on the equalizer user interface similar to that shown in FIG. 4A warning that a selected combination is impermissible.

In one embodiment, illustrated in FIG. 4B, the gaming software 102 presents a user interface 400-1 overlaid on the equalizer user interface 400 that warns the player that the player has created an impossible or impermissible combination. As shown, the user interface 400-1 comprises a message screen 412 with a message informing the user of the impossible or impermissible combination and instructions as to how to remedy the situation. For instance, the message may comprise the text: "The combination you have selected is not possible. Please select another combination." The player must attempt another combination by first selecting the "OK" icon 414, causing equalizer user interface 400 (FIG. 4A) to reappear, thereby allowing the player to reselect his or her volatility configuration. The player can then adjust their choices to create a combination that is mathematically possible or permissible.

The user interface 400-1 and/or the message screen 412 is but one example, among many, that may be used in the event of impossible or impermissible combinations. For instance, in some embodiments, instead of, or in addition to, providing a warning message on the screen, an alarm may sound, or a change of colors (e.g., differentiating the impossible or impermissible combinations) in the equalizer user interface 400 may be presented, or some combination thereof. As another example, some embodiments may choose to provide the user interface 400-1 on a separate screen (e.g., not overlaid on the equalizer user interface 400).

In some embodiments, the gaming software 102 automatically prevents the player from selecting a mathematically impossible or impermissible combination. For instance, the gaming software 102 can be configured to prohibit a player from successfully selecting an impossible or impermissible combination by automatically preventing the movement of (e.g., disabling) one or more of the levers 402 (or preventing the acceptance of one or more moved lever positions) to a position corresponding to an impossible or impermissible mathematical combination. As another example, the gaming software 102 can be configured to automatically adjust one or more of the levers 402 (corresponding to a payout volatility parameter), other than the one controlled by the player, to compensate for the impossible or impermissible change made by the player, in order to create a mathematically possible or permissible combination. In such embodiments, where automatic adjustment of the payout volatility parameters (via the levers 402, for example) is taking place, various visual and/or audio feedback may be presented to the player.

In operation, the gaming software 102, responsive to the selections made in the equalizer user interface 400, adds to or removes winning combinations from the pay tables. That is, the gaming software 102 (e.g., the computation module 109) reconfigures the parameters of the pay tables 107 to provide the adjusted payout volatility while maintaining the preprogrammed payout or return. Upon the user adjusting the payout volatility in the equalizer user interface 400, the gaming software 102 compares and matches the selected volatility to the pay tables 107 and loads the pay tables based on the player selection. In some embodiments, other mechanisms may be used.

Figure 5:
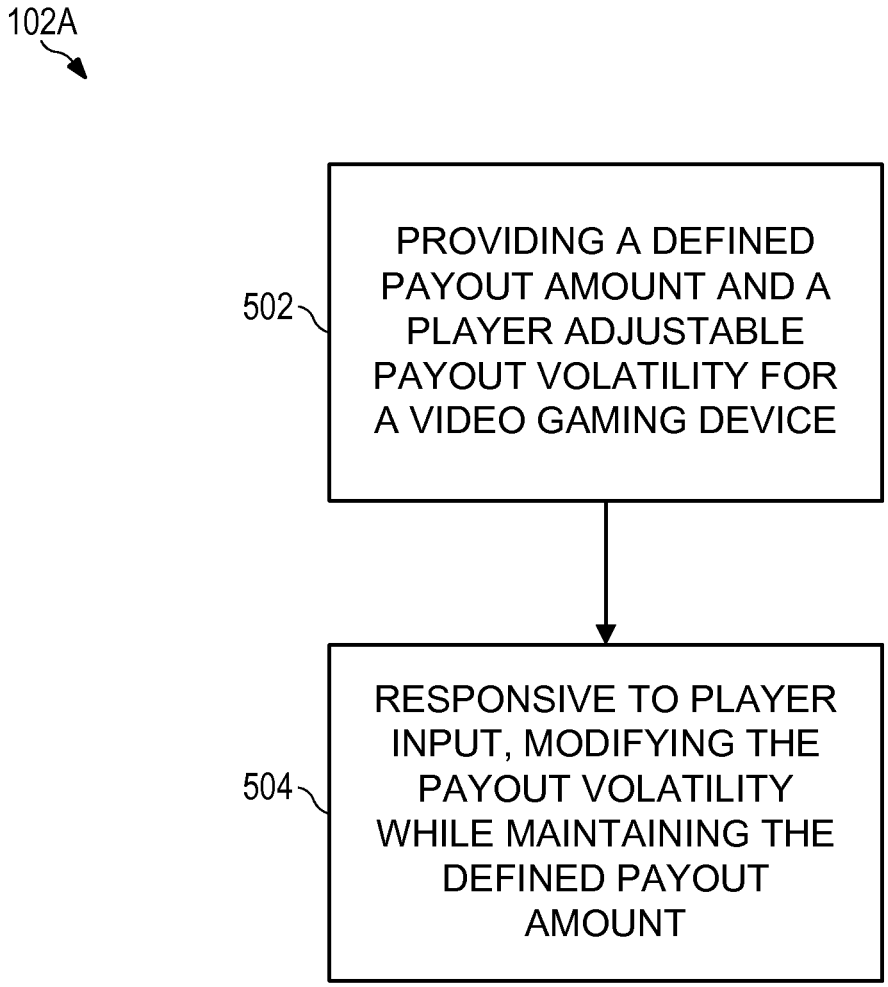
FIG. 5 is a flow diagram of an embodiment of a gaming method.

Having described various embodiments of the gaming system 100, one should appreciate in the context of the disclosure that one method embodiment 102 *a*, shown in FIG. 5, comprises providing a defined payout amount and a player adjustable payout volatility for a video gaming device (502), and responsive to player input, modifying the payout volatility while maintaining the defined payout amount (504).

Figure 6:
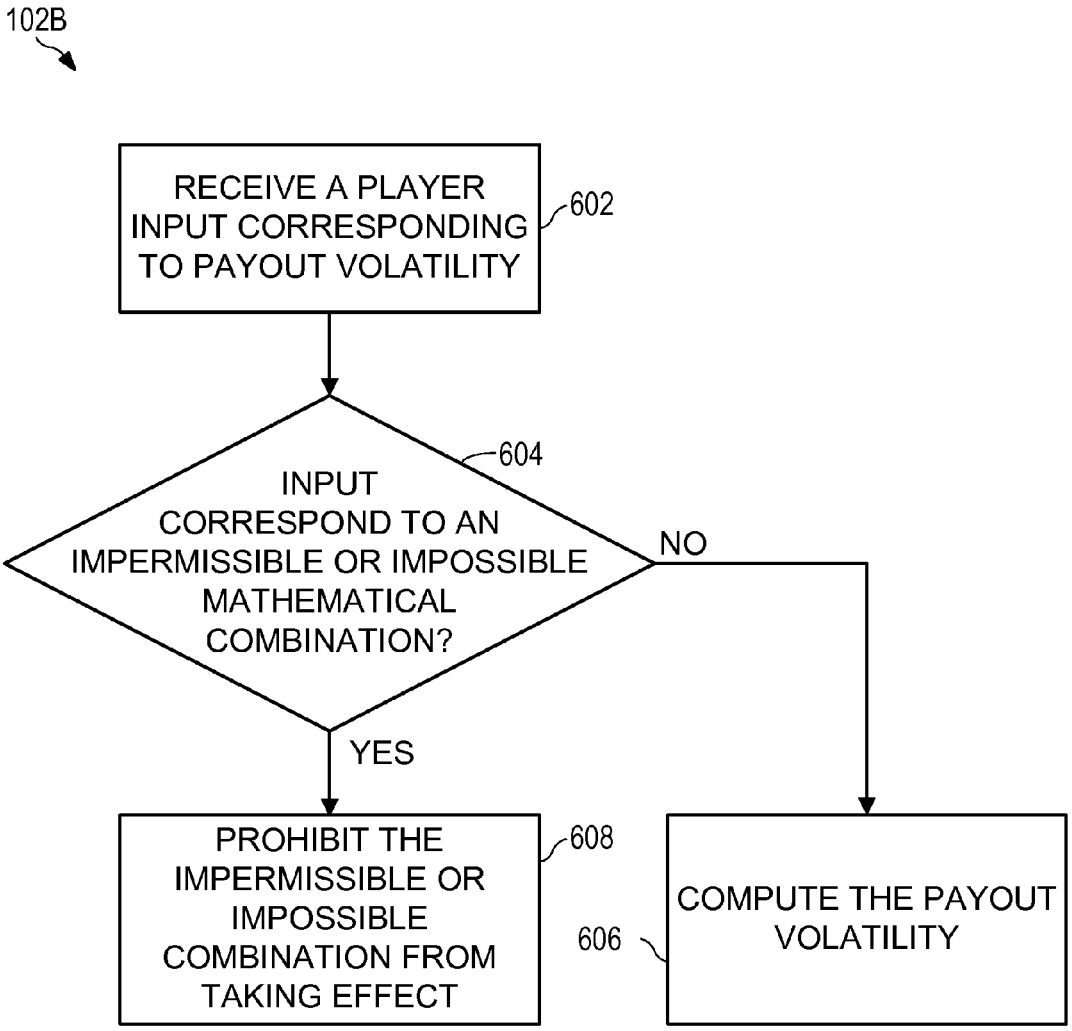
FIG. 6 is a flow diagram of an alternate embodiment of a gaming method.

Another embodiment, denoted as method 102 *b* and shown in FIG. 6, comprises receiving a player input corresponding to payout volatility (602), determining whether the input corresponds to an impermissible or impossible mathematical combination (604), and, if not impermissible or impossible, computing the payout volatility (606) or otherwise prohibiting the impermissible or impossible combination from taking effect (608).

It should be appreciated that the methods described herein are not limited to the systems or devices described above and shown in the accompanying figures.

Any process descriptions or blocks in flow charts should be understood as representing modules, segments, or portions of code which include one or more executable instructions for implementing specific logical functions or steps in the process, and alternate implementations are included within the scope of certain embodiments in which functions may be executed out of order from that shown or discussed, including substantially concurrently or in reverse order, depending on the functionality involved, as should be understood by those reasonably skilled in the art.

It should be emphasized that the above-described embodiments, particularly, any "preferred" embodiments, are merely possible examples of implementations, merely set forth for a clear understanding of the principles of the disclosure. Many variations and modifications may be made to the above-described embodiments without departing substantially from the spirit and principles of the disclosure. All such modifications and variations are intended to be included herein within the scope of this disclosure and protected by the following claims.

In one example, a method may include providing a defined payout amount and a player adjustable payout volatility for a video gaming device; and responsive to player input, modifying the payout volatility while maintaining the defined payout amount. In another example, the defined payout amount is programmed into the video gaming device. In one example, the providing the player adjustable payout volatility step may further include providing a user interface that enables a player to modify the payout volatility. Further, the providing the user interface step may further include providing a touch screen display. In addition, the providing the user interface step may further include providing one or more display elements that enable a player to increase and decrease a frequency of one or more tier wins. In one example, the tier wins may include one or more of low tier wins, mid-low tier wins, middle tier wins, mid-high tier wins, and high tier wins. In another example, the providing a payout may be based on the payout volatility. In addition, the method may further include prohibiting input by a player that corresponds to an impossible or impermissible payout volatility combination by disabling the combination based on other selections made by the player. Further, the method may provide for visually differentiating the impossible or impermissible payout volatility combination. In addition, the prohibiting step may further include adjusting a payout volatility parameter, other than a parameter corresponding to the impossible or impermissible payout volatility combination, to compensate for a selection by the player that corresponds to the impossible or impermissible payout volatility combination. In another example, the method may further include providing visual feedback, audio feedback, or a combination of both that automatic adjustment of the payout volatility to compensate for the player input that corresponds to an impossible or impermissible payout volatility combination is taking place.

In another example, a system may include a memory with gaming software and a processor configured with the gaming software to provide a defined payout amount and a player adjustable payout volatility for a video gaming device, and responsive to player input, modify the payout volatility while maintaining the defined payout amount. In another example, the processor is further configured with the gaming software to generate a user interface, the user interface enabling a player to modify the payout volatility. In addition, the system may further include a touch screen display, on which the processor is further configured with the gaming software to provide the user interface. In another example, the user interface further includes one or more adjustable display elements that enable the player to increase and decrease a frequency of one or more tier wins. In addition, the tier wins includes one or more of low tier wins, mid-low tier wins, middle tier wins, mid-high tier wins, and high tier wins. Further, the processor is further configured with the software to display the payout volatility. In addition, the processor is further configured with the software to prohibit input by a player that corresponds to an impossible or impermissible payout volatility combination by disabling the combination based on other selections made by the player. In one example, the processor is further configured with the software to visually differentiate the impossible or impermissible payout volatility combination. In another example, the processor is further configured with the software to prohibit by adjusting a payout volatility parameter, other than a parameter corresponding to the impossible or impermissible payout volatility combination, to compensate for a selection by the player that corresponds to the impossible or impermissible payout volatility combination. In one example, the processor is further configured with the software to provide visual feedback, audio feedback, or a combination of both that automatic adjustment of the payout volatility to compensate for the player input that corresponds to an impossible or impermissible payout volatility combination is taking place.

In another example, a system may include means for providing a defined payout amount and a player adjustable payout volatility for a video gaming device; and responsive to player input, means for modifying the payout volatility while maintaining the defined payout amount. In another example, the system may include means for displaying the payout volatility.

In another example, a computer readable medium storing a computer program for enabling adjustable payout volatility may include logic configured to provide a defined payout amount and a player adjustable payout volatility for a video gaming device; and logic configured to, responsive to player input, modify the payout volatility while maintaining the defined payout amount. Further, the computer readable medium may include comprising logic configured to display the payout volatility.

The invention claimed is:

1. A method of providing game play via a video gaming device where the video gaming device includes a housing with a display screen, one or more processors, one or more memory modules, and a credit transfer device, the method comprising:

providing via the one or more processors a defined payout amount and an adjustable payout volatility option for the video gaming device;

providing via the one or more processors a user interface that enables a modification of a payout volatility via one or more adjustment devices that enable a party to increase and decrease a frequency of multiple tier wins, the one or more adjustment devices including a first adjustment device, the first adjustment device being configured to be disabled based on one or more settings for a second device;

determining via the one or more processors whether the payout volatility as selected by the party is permissible;

responsive to a determination that the payout volatility as selected by the party is permissible, modifying via the one or more processors the payout volatility while maintaining the defined payout amount;

providing game play by determining more wagers initiated via the video gaming device where the one or more wagers utilize credits transferred via the credit transfer device;

determining via the video gaming device a plurality of symbols to be displayed on the display screen;

displaying the plurality of symbols on the display screen of the video gaming device; and wherein the game play is based on the payout volatility.

2. The method of claim 1, wherein the defined payout amount is programmed into the video gaming device.

3. The method of claim 1, wherein providing the user interface further comprises providing a touch screen display.

4. The method of claim 1, wherein the tier wins comprises one or more of low tier wins, mid-low tier wins, middle tier wins, mid-high tier wins, and high tier wins.

5. The method of claim 1, further comprising providing a payout based on the payout volatility.

6. The method of claim 1, further comprising prohibiting input by the party that corresponds to an impossible or impermissible payout volatility combination by disabling the combination based on other selections made by the party.

7. The method of claim 6, further comprising visually differentiating the impossible or impermissible payout volatility combination.

8. The method of claim 7, wherein prohibiting further comprises adjusting a payout volatility parameter, other than a parameter corresponding to the impossible or impermissible payout volatility combination, to compensate for a selection by the party that corresponds to the impossible or impermissible payout volatility combination.

9. The method of claim 8, further comprising providing visual feedback, audio feedback, or a combination of both that automatic adjustment of the payout volatility to compensate for the party input that corresponds to an impossible or impermissible payout volatility combination is taking place.

10. A system including one or more gaming devices where at least one of the one or more gaming devices includes a housing with a display screen, one or more processors, one or more memory modules, and a credit transfer device, the system comprising:

a memory with gaming software;

one or more adjustment devices that enable a party to increase and decrease a frequency of multiple tier wins, the one or more adjustment devices including a first adjustment device, where the first adjustment device being configured to be disabled based on one or more settings for a second device; and a processor configured with the gaming software to provide a defined payout amount and an adjustable payout volatility for a video gaming device, the processor further configured with the gaming software to determine if a party selected payout volatility is permissible and responsive to player input, including increasing and decreasing a frequency of multiple tier wins via the one or more adjustment devices, and a determination that the party selected payout volatility is permissible, modify the payout volatility while maintaining the defined payout amount;

wherein the system provides game play by determining one or more wagers initiated via the video gaming device where the one or more wagers utilize credits transferred via the credit transfer device;

wherein the system determines a plurality of symbols to be displayed on the display screen of the video gaming device;

wherein the display screen of the video gaming device displays the plurality of symbols; and wherein the game play is based on the payout volatility.

11. The system of claim 10, wherein the processor is further configured with the gaming software to generate a user interface, the user interface enabling the party to modify the payout volatility.

12. The system of claim 11, further comprising a touch screen display, on which the processor is further configured with the gaming software to provide the user interface.

13. The system of claim 12, wherein the tier wins comprises one or more of low tier wins, mid-low tier wins, middle tier wins, mid-high tier wins, and high tier wins.

14. The system of claim 13, wherein the processor is further configured with the software to display the payout volatility.

15. The system of claim 14, wherein the processor is further configured with the software to prohibit input by the party that corresponds to an impossible or impermissible payout volatility combination by disabling the combination based on other selections made by the party.

16. The system of claim 15, wherein the processor is further configured with the software to visually differentiate the impossible or impermissible payout volatility combination.

17. The system of claim 16, wherein the processor is further configured with the software to prohibit by adjusting a payout volatility parameter, other than a parameter corresponding to the impossible or impermissible payout volatility combination, to compensate for a selection by the party that corresponds to the impossible or impermissible payout volatility combination.

* * * * *